United States Patent [19]

Marshall et al.

[11] Patent Number: 4,721,434

[45] Date of Patent: Jan. 26, 1988

[54] DAMPING MEANS FOR A STATOR

[75] Inventors: Larry A. Marshall, Tequesta; David A. Lewis, Stuart, both of Fla.

[73] Assignee: United Technologies Corporation, Hartford, Conn.

[21] Appl. No.: 937,590

[22] Filed: Dec. 3, 1986

[51] Int. Cl.[4] ..... F01D 5/10

[52] U.S. Cl. ..... 415/119; 415/191; 416/500

[58] Field of Search ..... 415/119, 190, 191, 216, 415/217, 218; 416/190, 193 A, 500

[56] References Cited

U.S. PATENT DOCUMENTS

| | | | |
|---|---|---|---|
| 3,302,926 | 2/1967 | Bobo | 415/216 |
| 3,442,442 | 5/1969 | Seiwert | 415/218 |
| 3,628,880 | 12/1971 | Smuland | 415/216 |
| 3,824,034 | 7/1974 | Leicht | 415/217 |
| 3,957,391 | 5/1976 | Vollinger | 415/217 |
| 3,978,664 | 9/1976 | Parker et al. | 415/218 |
| 4,285,633 | 8/1981 | Jones | 415/191 |
| 4,621,976 | 11/1986 | Marshall et al. | 415/191 |
| 4,639,189 | 1/1987 | Rosman | 415/139 |

FOREIGN PATENT DOCUMENTS

| | | | |
|---|---|---|---|
| 836371 | 6/1981 | U.S.S.R. | 416/500 |

*Primary Examiner*—Robert E. Garrett
*Assistant Examiner*—John T. Kwon
*Attorney, Agent, or Firm*—Norman Friedland

[57] ABSTRACT

A frictional damper is mechanically attached to a cast stator of the compressor section of a gas turbine engine so that a cantilevered end abuts one of the shrouds to prestress the individual ends of the vanes of the stator, which end is free to move by slotting that shroud between adjacent vanes.

10 Claims, 3 Drawing Figures

DAMPING MEANS FOR A STATOR

The invention was made under a Government contract and the Government has rights therein.

TECHNICAL FIELD

This invention relates to stator construction of a gas turbine engine and particularly to means for achieving frictional damping for a cast stator.

DESCRIPTION OF BACKGROUND ART

U.S. Pat. No. 4,621,976, Integrally Cast Vane and Shroud Stator With Damper granted to the co-inventors of this patent application, on Nov. 11, 1986 and assigned to United Technologies Corporation, the assignees of this patent application, discloses and claims a damping scheme utilized in the identical application as the present invention and is incorporated herein by reference. As noted from this patent, supra, an annular shaped channel is formed into the shroud of the cast stator and receives an annularly shaped (C-shaped in cross section) dampening element. The damping device is in essence, a spring that has one leg bearing against one side wall of the C-shaped annular channel and the other leg biased against the opposing parallel wall of the C-shaped channel. This effectively preloads the inner shroud of the vane and dissipates the energy occasioned by the vibratory motion of the component elements of the stator. The vanes are all mutually attached at both ends as part of the stator casting. The damper acts on this common surface and only inhibits that motion which is coupled onto this surface from the individual vanes. This invention constitutes an improvement over the one disclosed in the referenced patent.

This invention contemplates eliminating the C-shaped channel and restructuring the cast stator so as to effectively free one end of the cast stator and bias that end by a spring like damping element. In the preferred embodiment the inner shroud carries a depending annular member defining a radially inwardly extending support structure. One or more annularly shaped dampening elements are supported to this member having a free cantilevered end biasing the inner shroud. The inner shroud is slotted between adjacent vanes and the slot extends through the annular depending member allowing the inner shroud and the individually attached vanes to have freedom of movement, limited, however by the stiffness of the material used. The land seal element of the typical labyrinth seal is also supported to the depending member, so that damping of this element is also attained by this construction.

DISCLOSURE OF INVENTION

An object of this invention is to provide an improved damping scheme for a cast stator of the compressor section of a gas turbine engine. A feature of this invention is to attach a spring like damper generally annular in shape to complement the annular depending support member and being generally L-shaped in cross section. One leg of the L is fixedly secured to the depending support element and the other end is biased against the inner diameter of the inner shroud and the point of contact is located at the juncture where the movement of the shroud is maximized. In one embodiment, the inner shroud is slotted between adjacent vanes and in another embodiment the slot is precast. In either instance the free end of the vane together with the inner shroud segment is free to move. The frictional contact of the damper owing to the vibrating motion excited in the vanes and stator elements serves to dissipate the energy, reducing vibrating stress and preventing vane fatigue.

Other features and advantages will be apparent from the specification and claims and from the accompanying drawings which illustrate an embodiment of the invention.

BEST MODE FOR CARRYING OUT THE INVENTION

Figure 1:
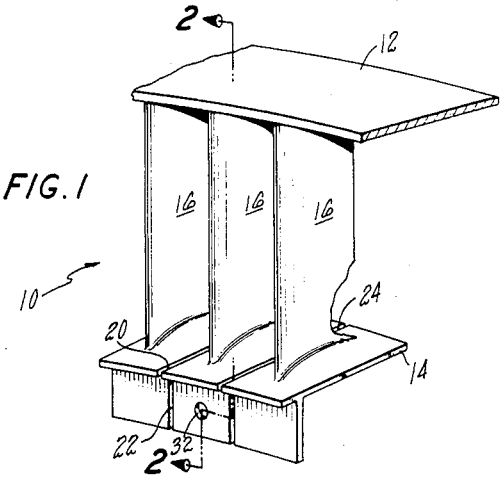
FIG. 1 is a partial showing of a cast stator incorporating the invention.

As was mentioned earlier, this invention constitutes an improvement over the damping scheme disclosed and claimed in U.S. Pat. No. 4,621,976, supra and for further details reference should be made thereto. For the purpose of understanding this invention reference is made to FIGS. 1 and 2 which disclose a single cast stator generally indicated by reference numeral 10 having an outer shroud 12 and an inner shroud 14 and a plurality of circumferentially spaced airfoils or vanes 16. The inner and outer shrouds 12 and 14 respectively, obviously, define the boundaries of the gas path and the vanes effectively direct the gas path to optimize the angle of attack of the gas path as being directed to the blades of the compressor rotor (not shown).

As is typical in stator construction, a seal, typically of the labyrinth type is supported to the vane to minimize leakages outside the gas path. To this end, stator 10 carries a radially depending element 18 cast integrally with the stator and is a continuous annular ring-like element. A series of axial slots 20 are cut into the inner shroud 14 (which slots may be cast therein) and complementary radial slots 22 (both made from the cutting operation) serves to allow each individual vane 16 to be free to move at the inner diameter. The width of space 24 is minimized and its thickness is predicated by the size of the cutting tool or manufacturing techniques. A filler of a synthetic material may be used to fill this space, which filler does not affect the movement of the vane. A generally circular or annular seal land support 26 having a platen portion 28 serves as the land for accommodating the teeth of the labyrinth seal element (not shown). Seal land support is attached to the forward or front face of depending members 18 and is attached thereto by a plurality of circumferentially spaced rivets 30 (one being shown), fitting into complementary holes 32, 32' and 32'' formed in one end of seal land support 26, depending member 18 and one leg of the damper 34 respectively.

According to this invention, the annularly shaped damper which is attached to the depending member 18 is mounted so that the cantilevered end 36 bears against the outer edge of the inner shroud at a point where there is the most relative motion between the vane and the point of contact of damping element 34. While it is shown to be adjacent the trailing edge 38 at this particular stator construction, could likewise have been employed adjacent the leading edge 40.

It is apparent from the foregoing that any movement occasioned by the excitation of the vanes caused by the flowing of the gas path will cause a relative movement between the contacting surfaces of the inner shroud 14 and damping element 34. Likewise, relative movement between the contacting surfaces of seal land support 26 and depending member 18 may also be evidenced either by the vane movement or the seal land support movement. Any such movement will effectively create friction between the mating surfaces at those points of contact. The energy of this movement, will be dissipated by the friction thus created and consequently will be dissipated in the form of heat. This friction damping action serves to reduce the vibratory stress in the stator and labyrinth seal preventing fatigue in both structures.

Figure 2:
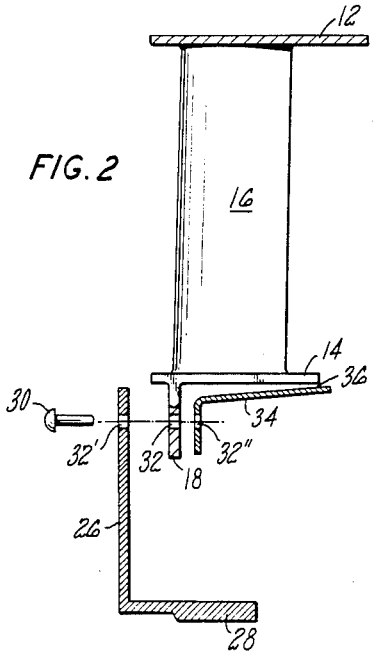
FIG. 2 is a sectional view when along line 2—2 of FIG. 1.
Figure 3:
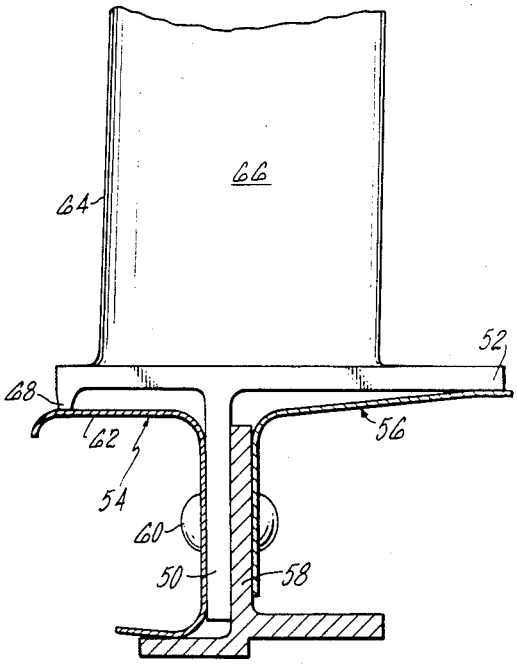
FIG. 3 is a partial view partly in section and partly in elevation illustrating another embodiment of this invention.

FIG. 3 exemplifies another embodiment of this invention. In fact this invention is employed in multiple stages of an axial compressor of a gas turbine engine and both embodiments represent two different stages. In FIG. 3, the depending member or foot 50 is spaced at a mid section of the inner shroud 52 and accommodates a pair of dampers 54 and 56, both of which are constructed similarly to the one described in FIGS. 1 and 2. The seal and support element 58 in this instance is supported to the aft face of foot 50, and defines the friction rubbing surfaces as was described above.

The annularly shaped dampening element 56 is identical to the one described in the assembly shown in FIGS. 1 and 2, but is attached to the face of seal land support element 58 by a plurality of rivets 60 also as described above. In this cast stator assembly, however, an additional annularly shaped dampening element 54 is utilized and is similarly attached to foot 50. Likewise it carries a cantilevered end 62 that bears against the inner shroud 52 adjacent the leading edge 64 of vane 66. The cast stator of this embodiment is similarly slotted as was the case of the cast stator in the FIGS. 1 and 2 assembly. A depending lip 68 is formed on the inner diameter of inner shroud 52 to define an abutting surface of damper 54.

As will be understood from the foregoing, the damper elements 54, 56 and 34 are all fabricated from material that exhibits a good spring characteristics and are selected to achieve a relatively high spring rate that is capable of operating in the environment of the compressor section of a gas turbine engine. The damper elements serve both in a damping function and sealing function.

By virtue of this invention the damper allows the use of the lower cost cast stator construction as compared with the cost of the heretofore well-known fabricated dampers. While the present invention is more expansive in terms of cost and weight than the damping scheme in U.S. Pat. No. 4,621,976, supra, it is superior in applications where a greater reduction in vibrating stress is required or desired. As is apparent in comparing both dampers, the present invention is a more effective damper since it restrains the motion of each individual vane and hence dissipates energy from a relatively smaller vane motion and is independent of dynamic coupling between individual vanes and the inner common surface as the situation in the structure disclosed in the U.S. Pat. No. 4,621,976, supra.

It should be understood that the invention is not limited to the particular embodiments shown and described herein, but that various changes and modifications may be made without departing from the spirit and scope of this novel concept as defined by the following claims.

What is claimed is:

1. A cast stator having a continuous shroud on one end and a non-continuous shroud on the other end concentrically disposed relative to the continuous shroud, circumferentially spaced vanes mounted between said continuous shroud and non-continuous shroud, a spring-like damper member contiguous to said non-continuous shroud prestressing said non-continuous shroud to load each of said vanes to limit movement thereof, and said spring-like damper member being in frictional engagement with and continuous around the periphery of said non-continuous shroud to dissipate the energy occasioned when said vane moves relative to said spring-like damper member.

2. A cast stator as claimed in claim 1, including a foot extending radially from said non-continuous shroud and being coextensive with said non-continuous shroud, means for attaching said spring-like damper member to said foot.

3. A cast stator as in claim 2 wherein said spring like damper member is an annular L-shaped member having one leg of said L attached to said foot and the other leg bearing against a surface of said non-continuous shroud.

4. A cast stator as in claim 3 wherein said other leg bears against said non-continuous shroud at a juncture that is commensurate with the maximum movement of said vane.

5. A cast stator as in claim 4 wherein a rivet secures said ring-like damper member to said foot.

6. A cast stator as in claim 5 including a seal support element extending radially from said foot and being supported thereto.

7. A cast stator as in claim 6 wherein said rivet secures said seal support element.

8. A cast stator having an outer shroud and an inner shroud concentrically disposed relative to the outer shroud, circumferentially spaced vanes mounted between said outer shroud and said inner shroud, a first annularly shaped damper means prestressing said inner shroud to load each of said vanes to limit movement thereof, and said first annularly shaped damper means being in frictional engagement with one edge of said inner shroud to dissipate the energy occasioned when each of said vanes moves relative to said first damper means and said inner shroud being slotted to permit independent movement of each of said vanes.

9. A cast stator as claimed in claim 8, including a foot extending radially from said inner shroud and being coextensive with said inner shroud, means for attaching said first annularly shaped damper means to said foot, and said foot being slotted to compliment the inner shroud.

10. A cast stator as in claim 9 including a second annularly shaped damper means being in frictional engagement with the opposing edge of said inner shroud.

* * * * *